US006339647B1

(12) United States Patent
Andersen et al.

(10) Patent No.: US 6,339,647 B1
(45) Date of Patent: Jan. 15, 2002

(54) HEARING AID WITH BEAM FORMING PROPERTIES

(75) Inventors: Henning Hougaard Andersen, Hørsholm; Carl Ludvigsen, Valby, both of (DK)

(73) Assignee: Topholm & Westermann APS, Vaerlose (DK)

( * ) Notice: Subject to any disclaimer, the term of this patent is extended or adjusted under 35 U.S.C. 154(b) by 0 days.

(21) Appl. No.: 09/763,692

(22) PCT Filed: Feb. 5, 1999

(86) PCT No.: PCT/EP99/00767

§ 371 Date: Feb. 26, 2001

§ 102(e) Date: Feb. 26, 2001

(87) PCT Pub. No.: WO00/47015

PCT Pub. Date: Aug. 10, 2000

(51) Int. Cl.[7] ..... H04R 25/00
(52) U.S. Cl. ..... 381/312; 381/316; 381/318
(58) Field of Search ..... 381/312, 313, 381/314, 316, 317, 318, 321

(56) References Cited

U.S. PATENT DOCUMENTS 5,305,004 A 4/1994 Fattaruso
5,946,402 A * 8/1999 Nishio et al.

FOREIGN PATENT DOCUMENTS

| | | | |
|---|---|---|---|
| DE | 4441996 A1 | | 5/1996 |
| EP | 0820210 | * | 1/1998 |
| WO | WO 96/16482 | | 5/1996 |
| WO | WO 98/47227 | | 10/1998 |

* cited by examiner

*Primary Examiner*—Sinh Tran
(74) *Attorney, Agent, or Firm*—Sughrue Mion, PLLC

(57) ABSTRACT

A hearing aid with beam forming properties, having at least two microphone channels (1*a*, 1*b*) for at least two microphones (2*a*, 2*b*), the microphone channels each comprising an analog to digital converter (3*a*, 3*b*) and having at least one programmable or program controlled signal processor (5), as well as a digital to analog converter, and at least one receiver and a battery for power supply. The hearing aid particularly comprises in each microphone channel (1*a*, 1*b*) a sigma-delta-type analog to digital converter (3*a*, 3*b*) including a digital low pas filter and a decimator 94) for converting a 1 Bit Stream of a high clock frequency into a digital word sequence of a lower clock frequency. At least one of the at least two microphone channels contains a controllable delay device (6) connected to the input side of the respective digital low pass filter and decimator (4) of the channel, the delay device (6) being controllable by the at least one signal processor (5). The delay device is preferably integrated into the sigma-delta-ADC (3).

12 Claims, 6 Drawing Sheets

HEARING AID WITH BEAM FORMING PROPERTIES

BACKGROUND OF THE INVENTION

In the EP 0820210 A2 a method and apparatus for beam forming of the microphone characteristic has been disclosed, by which a pre-determined characteristic of amplification in dependency of the direction from which acoustical signals are received at two spaced apart microphones is formed in that repetitevely a mutual delay signal is determined from the output signals of the microphones and according to the reception delay of the microphones, one of the output signals is filtered, thereby the filtering transfer characteristic is controlled in dependency of the mutual delay signal. The output signal of the filtering is exploited as electrical reception signal.

Thus, in principle the time delay or phase lag between the two output signals of the two microphones is used for a beam forming operation.

In a digital hearing aid the single samples are taken with a time difference equally divided by the sampling frequency, f.i. normally 32 usec. The desired delay between two or more microphone signals are typically less than 32 usec, e.g. 15 usec. A way to obtain a delay which is less than one sample is to have the DSP interpolate signal values between two samples with a certain delay and use those delayed sample values in the further processing. But this requires many calculations and takes up valuable space and power in the DSP.

Also, the signal will be somewhat distorted as the delyed samples are not "true" samples.

However, for an active control of beam forming properties in a directional hearing aid, the delays that could be realized, based on the sample frequency and conventional shift register technology would be much too long to be useful.

In order to realize sample delays as low as 1 usec the conventional technology can not be used.

Thus, it is an object of the present invention to create a novel hearing aid with beam forming properties in which an active control of the delay of at least one of the incoming signals of a hearing aid having at least two microphones can be used for active beam forming. With such a hearing aid a great number of various directional orientations of hearing aids could actively and controllably be realized.

Particularly, by using faster sampling rates, the samples because of their shorter time intervals could be used directly, so that desirable short delays could be realized.

By using a sigma-delta converter with a sampling rate or clock frequency of f.i. 1 MHz and by inserting a 1 bit adjustable and controllable digital delay line in the bit stream from one of the sigma-delta converters to the corresponding decimator filter of the converter one could obtain delayed difference steps of multiples of 1 usec, which could not be achieved with conventional hearing aid technology.

In connection with a single channel hearing aid, it is known per se from German published patent application No. 44 41 996 to use a high-frequency-clocked signal-delta converter as part of an advantageous amplifier stage.

SUMMARY OF THE INVENTION

For this purpose a new hearing aid with beam forming properties has been developed, which has at least two microphone channels for at least two microphones, said microphone channels containing each an analog to digital converter, and having at least one programmable or programmed digital signal processor, as well as a digital to anlalog converter, at least one receiver and a battery for power supply.

This new hearing aid, in accordance with the present invention, contains in each of said microphone channels a sigma-delta-type analog to digital converter including a digital low pass filter and decimator filter for converting a 1 bit stream of a high clock frequency into a digital word sequence of a lower clock frequency, whereby at least one of said at least two microphone channels contains a controllable delay device connected to the input side of the respective digital low pass filter and decimator filter of said channel, said delay device being controllable by said at least one digital signal processor.

It is advantagous to have said delay device integrated into the sigma-delta ADC.

It is of particular importance to use, as a delay device, a programmable or program controlled tapped shift register for realizing various different delays of the bit stream signals before their entering the respective digital low pass filter and decimator. In order to realize controllable delays as short as 1 usec it is of advantage to use a clock frequency for the sigma delta ADC in the range of 1 MHz or even higher and a clock frequency in the area of 10 to 50 kHz for the digital low pass filter and decimator filter.

It is now obvious that with such a configuration of the input side of a beam forming hearing aid with active beam control various additional possibilities exist which are subject of the remaining claims. Particularly, by this new hearing aid a very high resolution delay may be achieved.

BRIEF DESCRIPTION OF THE DRAWINGS

The invention will now be described in more detail in conjunction with several embodiments and the accompanying drawings:

In the drawings

FIG. 1 illustrates four different directional patterns in polar diagrams.

However, by controlling the various delay devices, other directional patterns could be realized. This will be more evident from the following description of the FIGS. 2 to 7.

DETAILED DESCRIPTION OF PREFERRED EMBODIMENTS OF THE INVENTION

As has been explained above, for realizing hearing aids in accordance with the present invention, normal analog to digital converters operating with clock frequencies of 16 or 32 kHz could not be used for realizing delays in the range of 1 usec or multiples thereof.

Figure 1A:
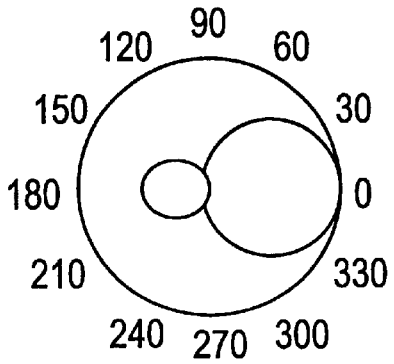
FIG. 1*a* represents the hypercardioid system which has a very desirable directional effect. 1*b* is the bidirectional. System which has no delay for any of the two microphones and therefore attenuates all sounds coming directly from the sides (90 degrees and 270 degrees) as the two microphones level out each other. 1*c* is the cardioid which must have a delay in the front microphone equal to the longitudinal delay between the inlet ports of the two microphones. Finally, 1*d* is the omnidirectional or spherical system, which is simply a single microphone (the other microphone is switched off), or the two microphone signals are added and not subtracted from each other.
Figure 1B:
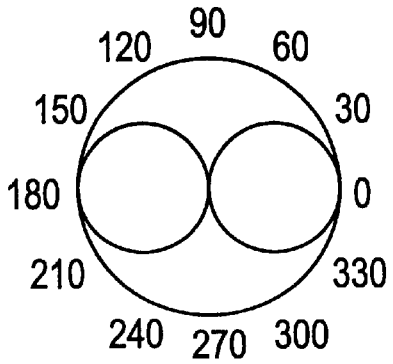
FIG. 1 shows schematically a number of polar diagrams of variations of beam directions which could be realized by the present invention.
Figure 1C:
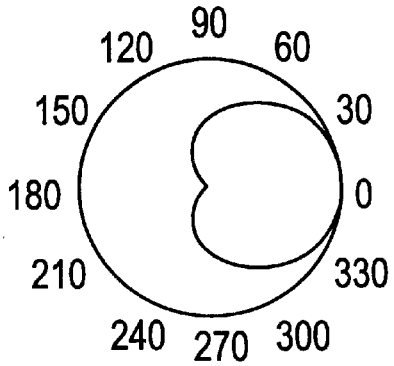
Figure 1D:
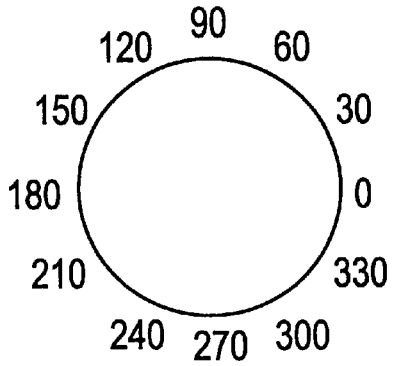
Figure 2:
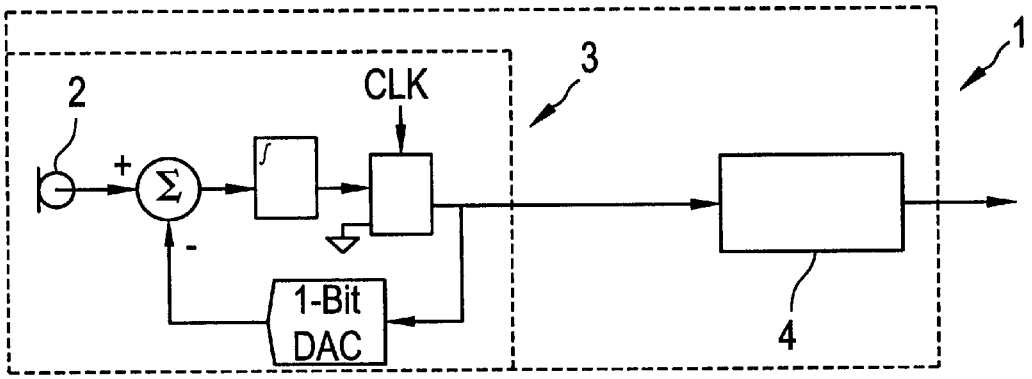
FIG. 2 PRIOR ART
FIG. 2 shows schematically the general structure of a sigma-delta analog to digital converter (ADC)

FIG. 2 shows a well known type of a first order sigma-delta digital to analog converter comprising basically a summing circuit, an integrator, a comparator stage (1 bit ADC) and a digital low pass filter 4 and a decimator filter. The comparator stage is controlled by a high frequency clock generator supplying clock pulses in the aerea of 1 MHz or higher. The output of the integrator is connected also to a 1 bit DAC, the output of which is connected to a second input of the summing circuit. The digital low pass filter and decimator filter operates at a clock frequency of f.i. 32 kHz and converts the 1 bit stream of a clock frequency of about 1 MHz into a sequence of data words at the lower frequency, f.i. 16 or 32 kHz. These data words could e.g. be 20 bit wide. These data words are then, normally, applied to a programmable or program controlled digital signal processor.

It is to be understood that all embodiments of the invention will make use of such sigma-delta-type ADC's, provided a high clock frequency in the area of 1 MHz or higher is used for controlling the comparator.

Figure 3:
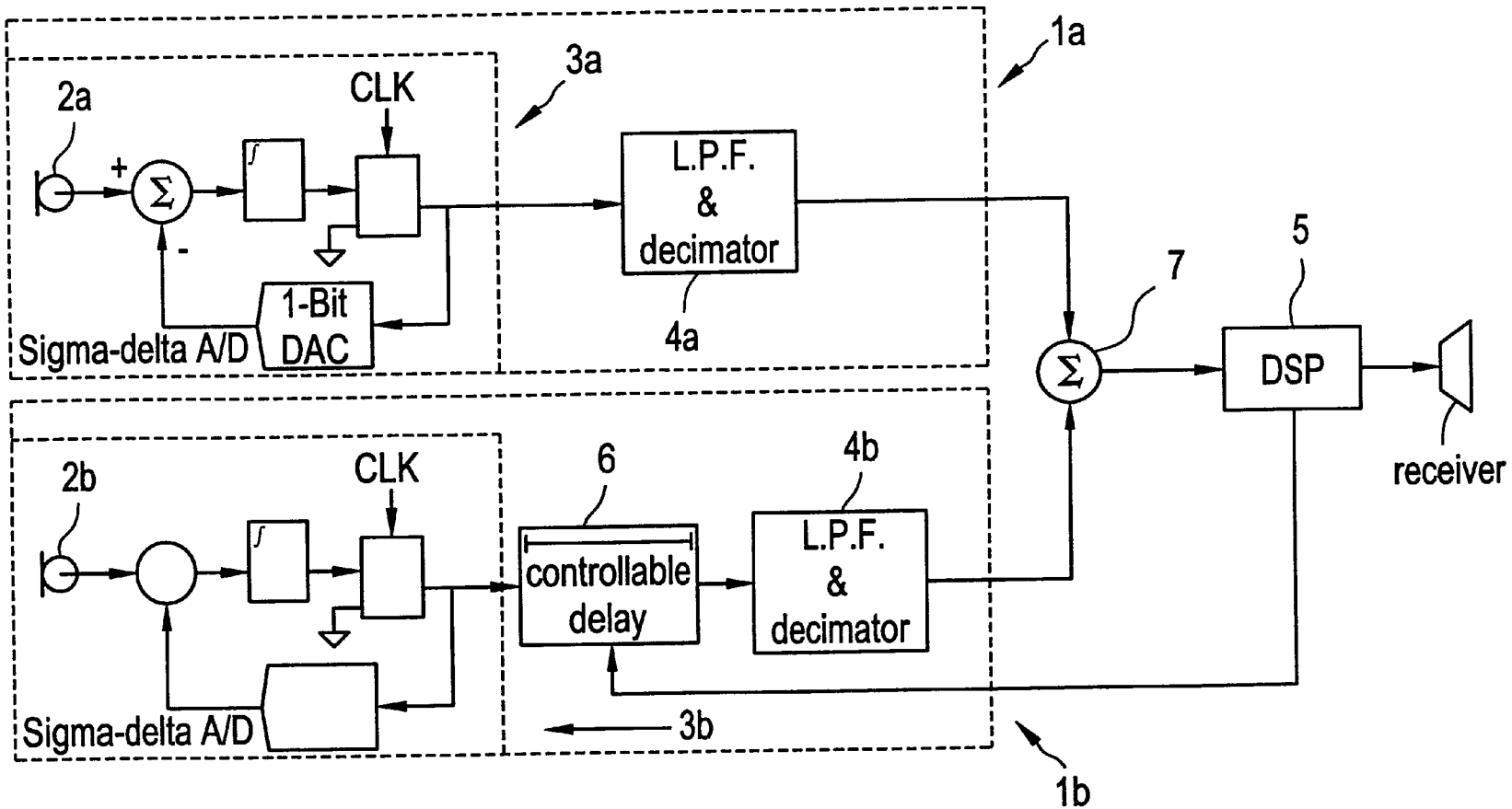
FIG. 3 shows schematically a first embodiment of the invention.

FIG. 3 shows, schematically, a first example of the inventive conceptual design.

Two microphone channels 1*a* and 1*b* comprise microphones 2*a* and 2*b* and sigma-delta analog to digital converters 3*a*, 3*b* including digital low pass filters and decimator filters 4*a* and 4*b* for supplying data words to a programmable or program controlled digital signal processor 5.

In one of the microphone channels a controllable delay device 6 is included. This delay device is typically a multiple tap shift register and the control signal coming from the DSP 5 will decide how many 1 bit stages each sample of the bit stream will go through (and thus be delayed by) before they are tapped and sent furtheron in the system, in this case to the digital low pass filter and decimator 4. The resulting delay is equal to the number of stages times the inverse sampling rate, f.i. 1 MHz.

With this high resolution of the sigma-delta ADC the time resolution can be 30–40 times higher than would be possible inside the DSP using its clock as a basis for delays. Normally, this setup can only handle beam forming from the front or from the back but not both. The controllable delay would be controlled by the DSP so that the DSP direct the beam in the desired directions.

Figure 4:
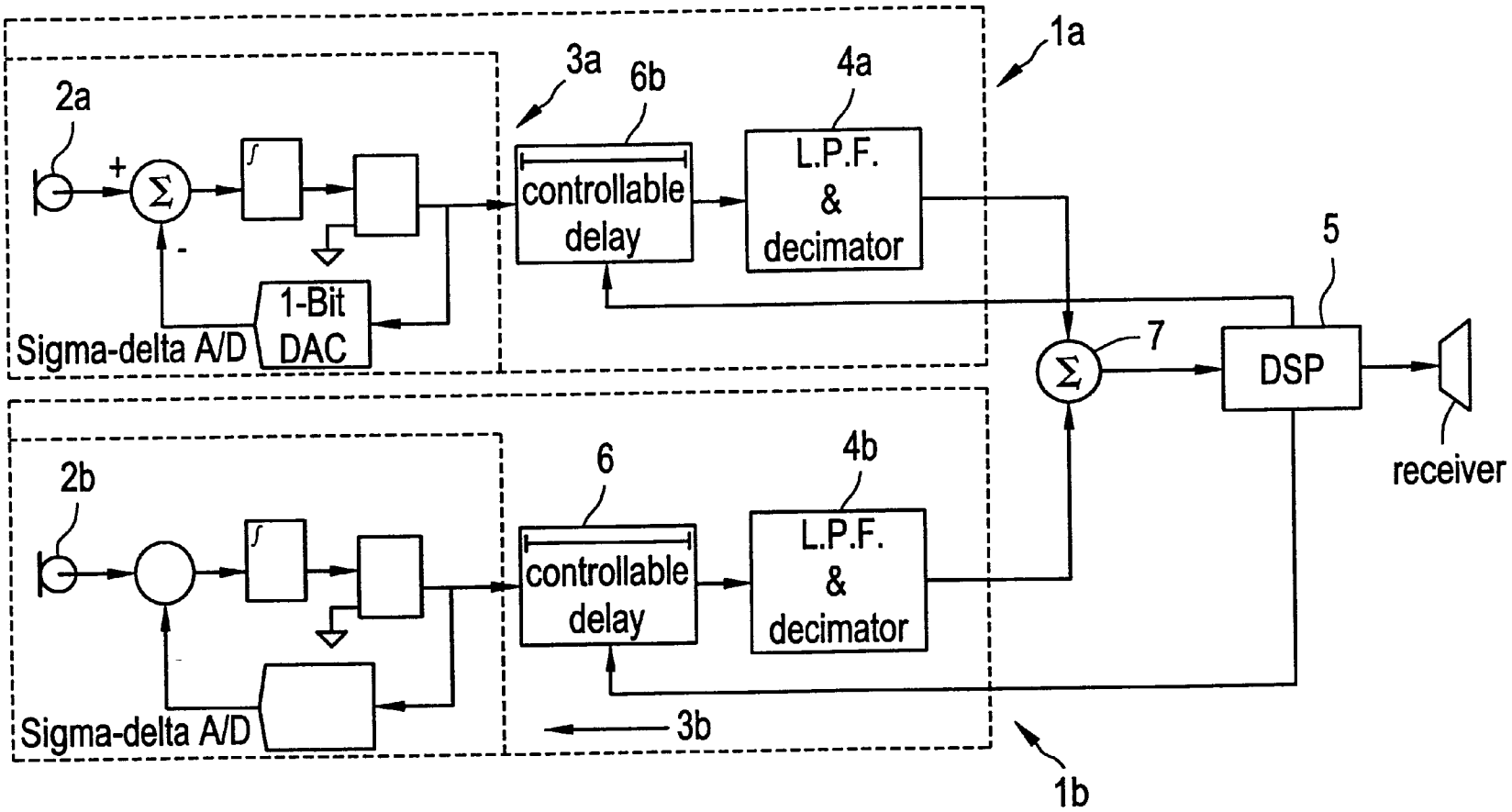
FIGS. 4, 5, 6 and 7 schow schematically further embodiments of the invention.

FIG. 4 shows a further embodiment of the invention. All parts and components which are the same as in FIG. 3 are designated with the same reference numerals and need not to be described again. This holds true for all other FIGS. as well so that only the differences will be explained in detail.

In FIG. 4 both microphone channels 1*a* and 1*b* contain each a controllable delay device 6*a*, 6*b*. They can, of course, be controlled independently and separately. Although two delay devices are included,only one of the two may be controlled whereas the other is switched off.

The output signals of the digital low pass filter and decimator filters 4*a* and 4*b* are combined in a summing circuit 7 and passed on to the DSP. Thus, by having controllable delay in both sigma-delta converters it will be possible to reverse the beam forming operation and use it both at front and back.

Figure 5:
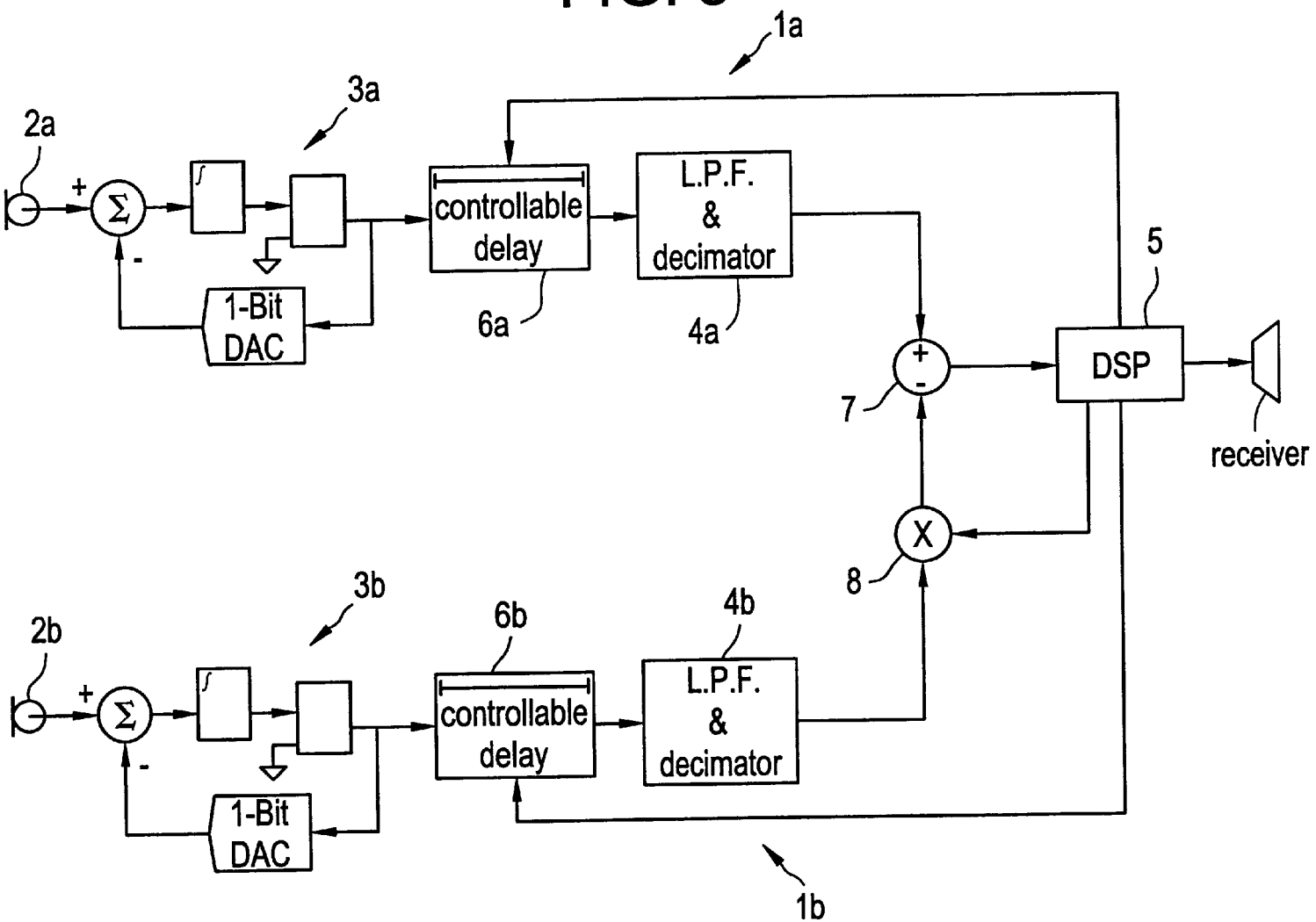

In FIG. 5, which in almost all respects is similar to FIG. 4, the output signal of the lower one of the two microphone channels 1*b* is now connected to a first input of a multiplier stage 8, the second input of which receives a controlling input from the DSP.

The output of the multiplier stage 8 is applied to the second input of the summing circuit 7, which feeds into the DSP.

It may be desirable to make a shift from e.g. the hypercardiodid to the omnidirectional characteristic. For this purpose the multiplier 8 is added after the digital low pass filter and decimator filter for one microphone or for both. The DSP then can multiply the samples with factors between −1 and +1.

Figure 6:
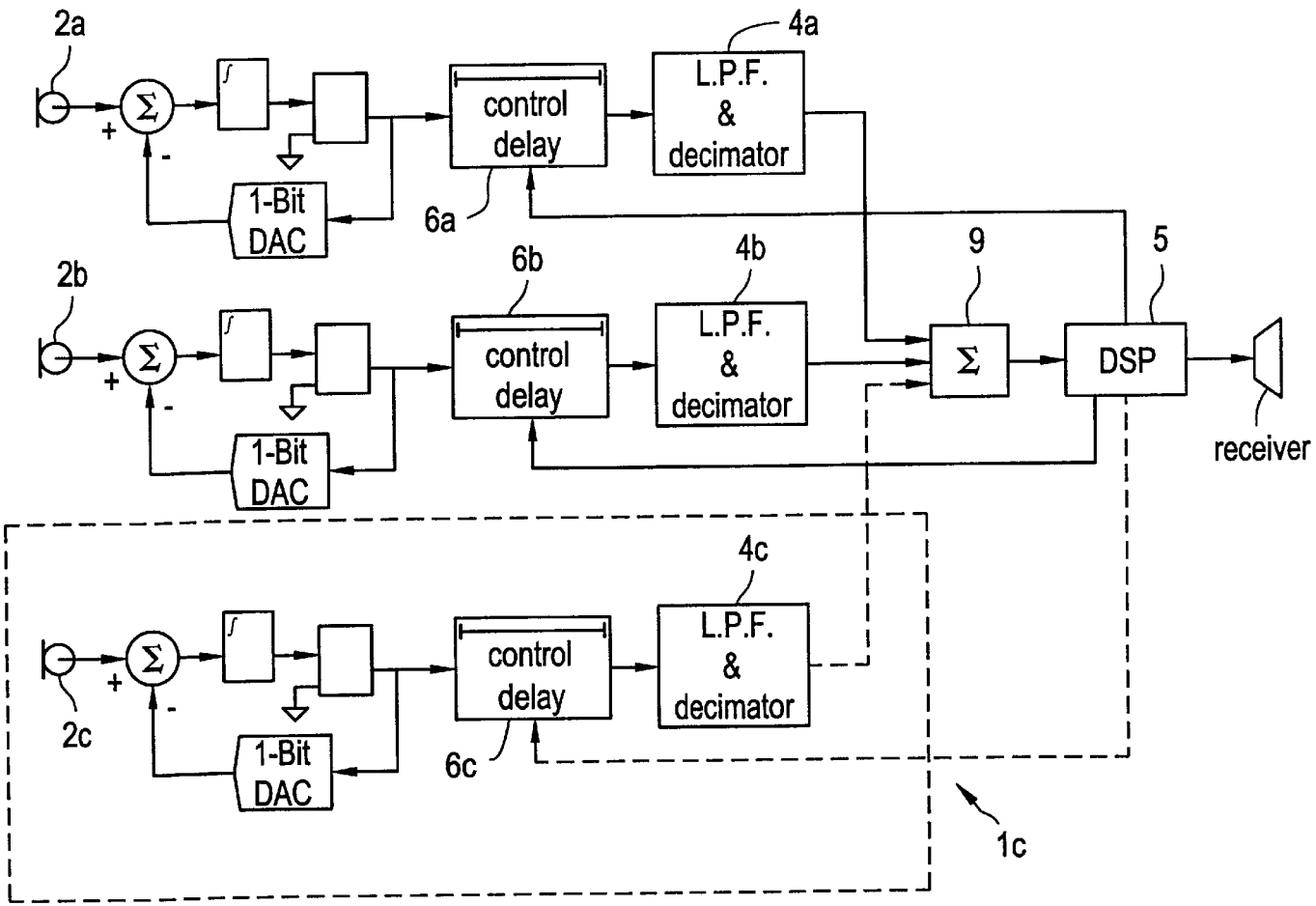

FIG. 6 shows the extension from two microphone channels to multiple microphone channels. Again, controllable delay devices may be arranged in one channel, in two channels or in all channels. The output signals of all channels are combined in a combination circuit 9, the output signals of which are applied to the DSP. This combination could be effected with different factors between −1 to +1, if convenient.

Figure 7:
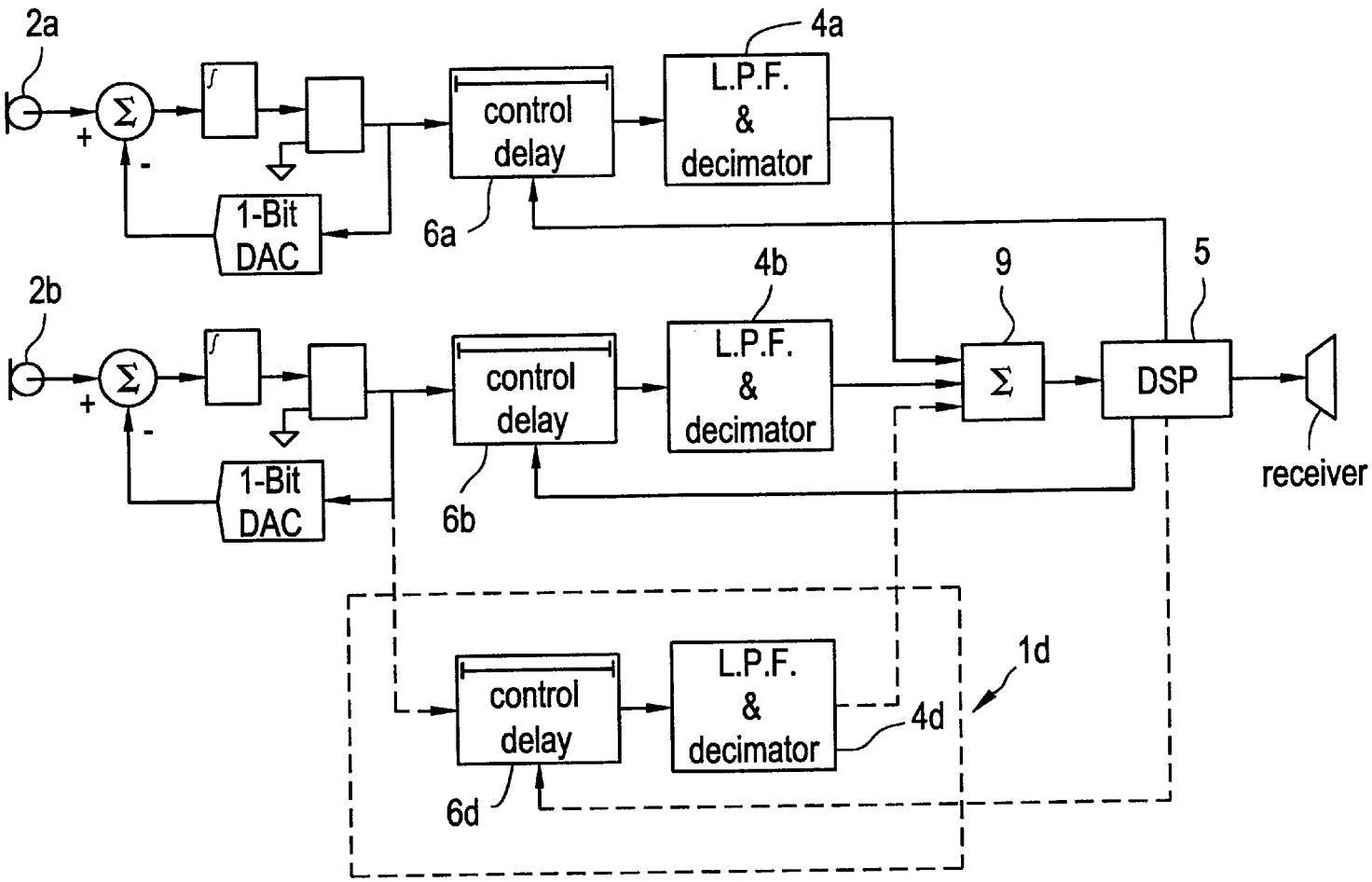

FIG. 7 finally, shows another variation of the inventive circuit in which at least one of the microphone channels has not only one delay device and one digital low pass filter and decimator filter but two of those in parallel. It is also conceivable to have these parallel arrangements in one or more channels, even in all of them.

It is also possible to use more than two delay devices in parallel in at least one of said microphone channels, all connected to their respective digital low pass filter and decimator filter of said at least one of said channels.

What is claimed is:

1. Hearing aid with beam forming properties, comprising at least two microphone channels (1*a*, 1*b*) for at least two microphones (2*a*, 2*b*), a digital programmable or program controlled signal processor (6), a receiver and a battery for power supply, wherein each microphone channel (1*a*, 1*b*) contains a sigma-delta-type analog to digital converter (3*a*, 3*b*), a digital low pass filter and decimator (4) for converting a 1 Bit stream of a high clock frequency of said converter into a digital word sequence of a lower clock frequency, and at least one of said at least two microphone channels contains a controllable delay device (6) connected to the input side of the respective digital low pass filter and decimator (4) of said channel, said delay device (6) being controllable by said processor (5).

2. Hearing aid in accordance with claim 1, wherein the delay device (6) is integrated into said sigma-delta-converter (3).

3. Hearing aid in accordance with claim 1, wherein a first order sigma-delta converter is used in said at least two microphone channels.

4. Hearing aid in accordance with claim 1, wherein a second order or even higher order sigma-delta-converter is used in said at least two microphone channels.

5. Hearing aid in accordance with claim 1, wherein the clock frequency for the sigma-delta-converter (3) is in the range of 1 MHz or higher and that said lower clock frequency for the digital word sequence is in the range of 10 to 50 kHz.

6. Hearing aid in accordance with claim 1 wherein said delay device comprises a programmable or program controlled tapped shift register for realizing various different delays of said one bit stream before entering said digital low pass filter and decimator.

7. Hearing aid in accordance with claim 1, wherein the output signals of said at least two microphone channels are combined in a summing circuit (7) for controlling said processor.

8. Hearing aid in accordance with claim 1, wherein in each said sigma-delta converter (3*a*, 3*b*) of said at least two microphone channels (1*a*, 1*b*) the controllable delay device (6*a*, 6*b*) is included.

9. Hearing aid in accordance with claim 1, wherein one of said at least two microphone channels is directly connected to the summing circuit (7), whereas the other of said at least two microphone channels is connected to a first input of a multiplier stage (8), the output of which is coupled to said summing circuit (7), whereas a second input of said multiplier stage (8) is controlled by the digital signal processor (5).

10. Hearing aid in accordance with claim 1, wherein each of said at least two microphone channels being equipped with sigma-delta analog to digital converters (3) including at least in some of them said controllable delay devices, the outputs of which are combined in a combination circuit, or an integrator circuit, said circuit is (9) connected to the input side of said processor (5).

11. Hearing aid in accordance with claim 1, wherein said at least one of the said at least two microphone channels is equipped with a sigma-delta analog to digital converter including at least two delay devices in parallel operating on two digital low pass filters and decimators, the output signals of all said digital low pass filters and decimators are being combined in a combination circuit connected to the input side of said at least one digital signal processor.

12. Hearing aid in accordance with claim 1, wherein a remote control unit for controlling the said digital signal processor for effecting various beam forming directional orientations of said at least two microphones by influencing one or more of said delay devices for introducing various different delays.

* * * * *